US005426910A

United States Patent [19]

Cullen

[11] Patent Number: 5,426,910

[45] Date of Patent: * Jun. 27, 1995

[54] MEANS FOR CREATING AIR CHANNELS IN BAGGED COMPOST MATERIAL

[75] Inventor: Steven R. Cullen, Astoria, Oreg.

[73] Assignee: Versa Corp., Astoria, Oreg.

[ * ] Notice: The portion of the term of this patent subsequent to Sep. 13, 2011 has been disclaimed.

[21] Appl. No.: 215,200

[22] Filed: Mar. 21, 1994

Related U.S. Application Data

[63] Continuation of Ser. No. 949,447, Sep. 22, 1992, Pat. No. 5,345,744.

[51] Int. Cl.[6] ..... B65B 43/26; B65B 61/00

[52] U.S. Cl. ..... 53/128.1; 53/570; 53/576

[58] Field of Search ..... 71/9; 100/65, 98 A, 100/100, 144; 141/71, 73, 114; 53/111 R, 113, 128.1, 567, 570, 576, 410, 428, 459, 469, 473

[56] References Cited

U.S. PATENT DOCUMENTS

| | | | |
|---|---|---|---|
| 3,119,212 | 1/1964 | Zytka et al. | 53/473 |
| 3,164,695 | 1/1965 | Sanni | 53/410 X |
| 3,192,965 | 7/1965 | Smith | 141/73 X |
| 3,687,061 | 8/1972 | Eggenmuller et al. | 53/576 X |
| 3,791,593 | 2/1974 | Griffin | 239/667 |
| 4,230,676 | 10/1980 | Taylor et al. | 71/9 X |
| 4,308,901 | 1/1982 | Lee | 141/114 |
| 4,310,036 | 1/1982 | Rasmussen et al. | 141/114 |
| 4,337,805 | 7/1982 | Johnson et al. | 141/71 |
| 4,475,450 | 10/1984 | Stengel | 100/100 |
| 4,502,378 | 3/1985 | Cullen | 100/65 |
| 4,621,666 | 11/1986 | Ryan | 141/114 |
| 4,653,553 | 3/1987 | Cox et al. | 141/114 |
| 4,688,480 | 8/1987 | Ryan | 100/144 |
| 4,724,876 | 2/1988 | Ryan | 141/114 |
| 4,945,715 | 8/1990 | Brodrecht | 53/567 |
| 4,949,633 | 8/1990 | Johnson et al. | 100/65 |
| 4,951,452 | 8/1990 | Lundahl et al. | 100/98 A X |
| 5,159,877 | 11/1992 | Irman et al. | 100/144 |
| 5,269,829 | 12/1993 | Meyer | 71/9 |
| 5,295,554 | 3/1994 | Cullen | 180/236 |

*Primary Examiner*—Linda B. Johnson
*Attorney, Agent, or Firm*—Zarley, McKee, Thomte Voorhees & Sease; Dennis L. Thomte

[57] ABSTRACT

A compost bagging machine is described including a wheeled frame having a tunnel mounted thereon which is adapted to receive the opened mouth of a bag. The inside surface of the tunnel is provided with a plurality of spaced-apart flutes which create air channels in the material within the bag. An elongated perforated pipe is also positioned within the material in the bag and the bagging machine moves relative to the bag during the bagging operation. The presence of air in the channels created by the flutes and the air present in the perforated pipe ensures that sufficient air will be present in the mass to achieve complete decomposition of the material.

4 Claims, 4 Drawing Sheets

MEANS FOR CREATING AIR CHANNELS IN BAGGED COMPOST MATERIAL

CROSS-REFERENCE TO RELATED APPLICATION

This is a continuation application of application Ser. No. 071949,447 filed Sep. 22, 1992, now U.S. Pat. No. 5,345,744 issued Sep. 13, 1994.

BACKGROUND OF THE INVENTION

Agricultural feed bagging machines have been employed for several years to pack or bag silage or the like into elongated plastic bags. Two of the earliest bagging machines are disclosed in U.S. Pat. Nos. 3,687,061 and 4,046,068. More recently, U.S. Pat. Nos. 4,337,805 and 4,621,666 have issued which disclose modifications of the basic bagging machines. In all of the feed bagging machines of the prior art, the silage is packed into the bags in an air-tight condition so that proper fermentation of the silage material takes place. In the bagging machines of the prior art, an effort was made to eliminate air within the bags.

Recently, it has been discovered that compost material, or material to be decomposed or composted, may be composted in large plastic bags. In such a procedure, it is necessary that air be present in the material to be composted so that proper decomposition of the material takes place. It was first thought that a feed bagging machine such as that disclosed in the prior art patents identified hereinabove, could be utilized to place the materials to be composted into the bag. However, the feed bagging machines of the prior art simply are not suitable for fuse in placing the material to be composted in a bag since the material in the bag would not have sufficient air therein to enable the material to decompose.

It is therefore a principal object of the invention to provide a method and means for creating air channels in bagged compost material so that the compost material will properly decompose.

A further object of the invention is to provide a compost bagging machine which creates air channels in the bagged compost material.

A further object of the invention is to provide a compost bagging machine including means for positioning an elongated perforated pipe in the compost material.

A further object of the invention is to provide a compost bagging machine including a means for creating a plurality of spaced-apart air channels in the exterior surface of the bagged material.

Yet another object of the invention is to provide a method and means for creating air channels in bagged compost material which ensures that sufficient air will be present in the bagged compost material to enable tile material to efficiently decompose.

These and other objects of the present invention will be apparent to those skilled in the art.

SUMMARY OF THE INVENTION

Figure 1:
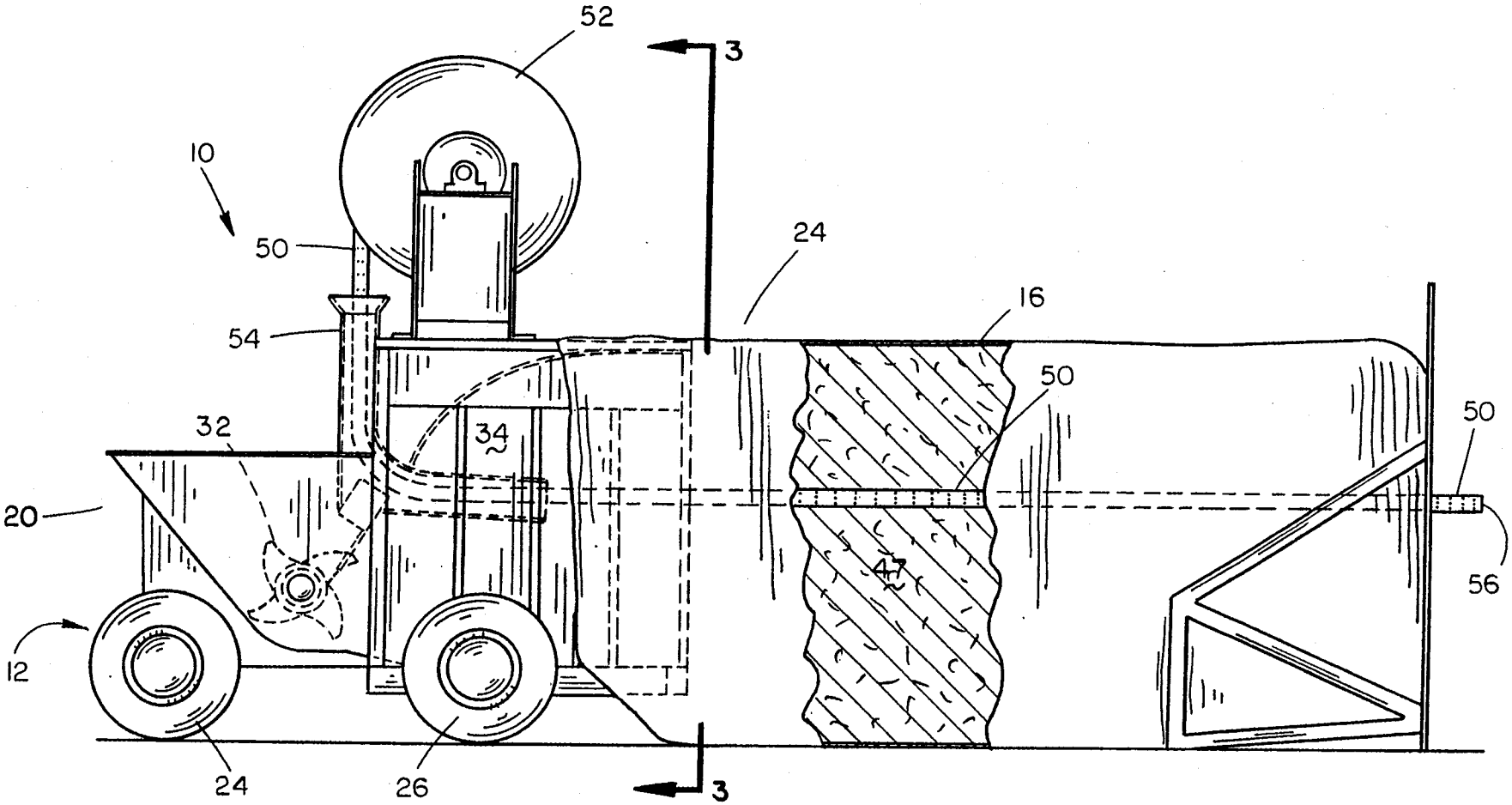
FIG. 1 is a side elevational view of the apparatus of this invention for creating air channels in bagged compost material.

A compost bagging machine is described which comprises a wheeled frame means having rearward and forward ends. A tunnel is provided on the wheeled frame means and has an intake end for receiving the material to be composted and an output end which is adapted to receive the mouth of a large plastic bag. A hopper is provided on the wheeled frame means for receiving the compost material and is adapted to supply the same to a rotatable rotor or the like which forces the material into the tunnel and into the bag. The interior surface of the tunnel is provided with a plurality of spaced-apart flutes which create grooves or channels in the exterior surface of the material as the material is being placed into the bag. The bagging machine also includes means for positioning an elongated perforated pipe in the material. The air present in the grooves in the material and the air present in the perforated pipe causes the material to properly decompose.

DESCRIPTION OF THE PREFERRED EMBODIMENT

The compost bagging machine of this invention is referred to generally by the reference numeral 10 and is of the type disclosed in my co-pending applications, Ser. No. 879,789 filed May 6, 1992, now abandoned, which is a continuation-in-part application of Ser. No. 815,942 filed Dec. 30, 1991, now abandoned the disclosures of which are relied upon to complete this disclosure.

Machine 10 includes a wheeled frame means 12 having a tunnel 14 mounted thereon upon which is normally positioned the open mouth of a bag 16 as illustrated in FIG. 1. For purposes of conciseness, the power means for driving the various components of the machine have not been disclosed since the same does not form a part of the invention. The power means could be an engine mounted on the machine or a PTO shaft for connection to a tractor PTO.

For purposes of description, the bagging machine 10 will be described as including a forward end 20 and a rearward end 22. Also for purposes of description, the wheeled frame means 12 of the bagging machine 10 will be described as including two pairs of front wheels 24 and two pairs of rear wheels 26 mounted on opposite sides of the machine in conventional fashion. A conventional braking means is provided and is well known in the prior art to resist the movement of the bagging machine 10 away from the fixed end of the bag 16 as the bag 16 is being filled.

Bagging machine 10 includes a hopper means 28 at the forward end thereof which is adapted to receive the material to be composted from a truck, wagon, etc. The design of the hopper means 28 does not form a portion of the invention and could be replaced by a conventional feed table.

A means is provided at the forward end of the tunnel 14 for forcing the material into the tunnel and into the bag. In the embodiment shown, a rotatable rotor 32 of conventional design is illustrated but it should be noted that the same could be replaced by any suitable means which forces the material to be composted into the bag.

For purposes of description, tunnel 14 will be described as including an outer surface 34 and an inner surface 36. Tunnel 14 also includes a top wall 38, side walls 40 and 42 and bottom wall 44.

A plurality of spaced-apart flutes or channels 46 are secured to the inner surfaces of top wall 38, side walls 40 and 42 and bottom wall 44 as seen in the drawings. Preferably, the flutes 46 are elongated and have a V-shaped cross section. It can also be seen that the flutes 46 are tapered so as to have an increasing height or depth from the forward to rearward ends thereof. The flutes 46 are preferably welded to the inside surfaces of the tunnel 14 in conventional fashion. As the material to be composted is forced through the tunnel 14 into the bag 16, the flutes or channels 46 create indentations, channels or grooves 48 in the exterior surface of the material 47 positioned in the bag 16 to ensure that air will be present within the bag to enable the material to properly decompose.

Means is also provided for positioning an elongated perforated pipe or tube in the approximate center of the mass so that additional air is provided to the mass to ensure that sufficient air will be present in the mass to achieve proper decomposition. The perforated pipe could either be a single, length of pipe 50 wound upon reel 52 or may be comprised of individual sections of pipe. It should be understood that it is preferred that the pipe 50 be positioned in the center of the mass of the material in addition to the channels 48. However, it is believed that sufficient air will be present to achieve decomposition with either the channels 48 or the perforated pipe 50 although it is preferred that both the flutes 46 and the pipe 50 be utilized. It should also be noted that even though the drawings only illustrate a single pipe being positioned in the mass, additional pipes could be positioned therein if necessary.

Figure 2:
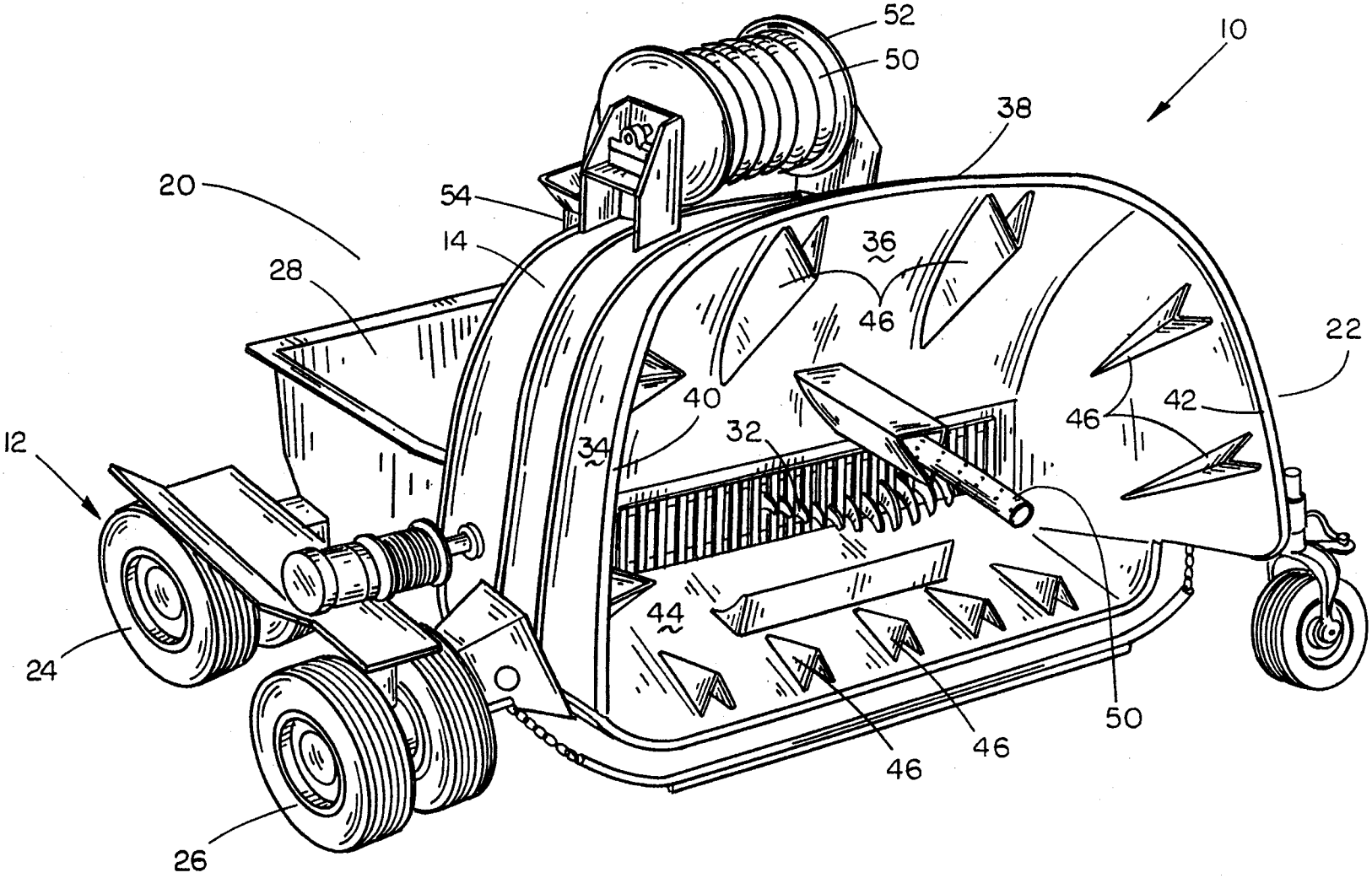
FIG. 2 is a rear perspective view of the bagging machine.
Figure 3:
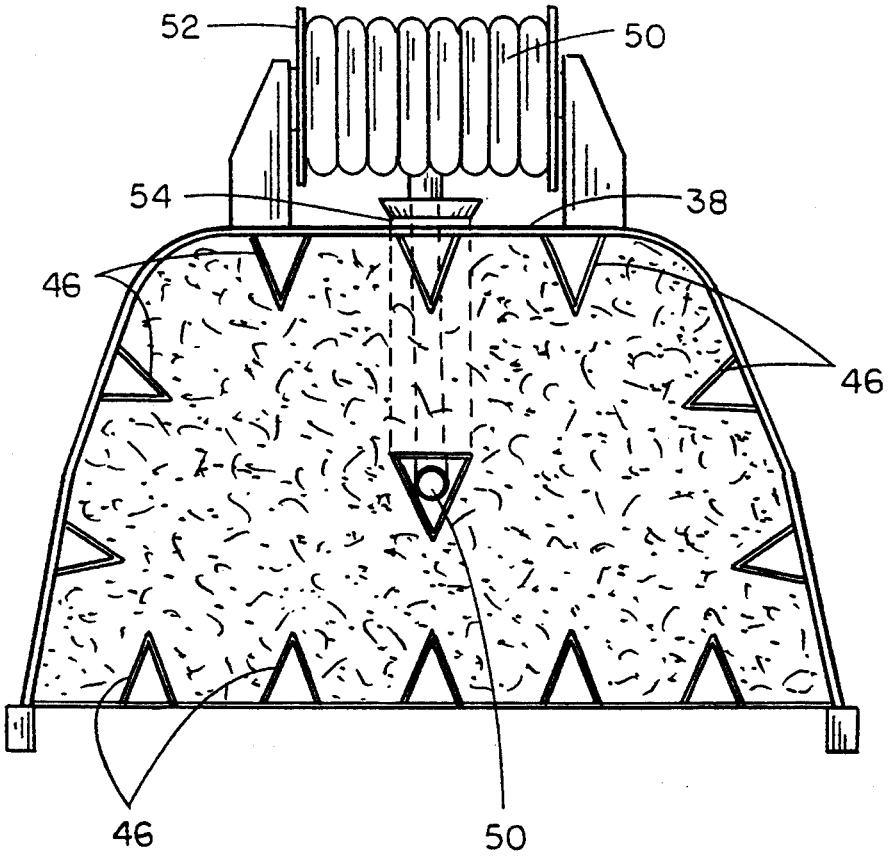
FIG. 3 is a sectional view seen on lines 3—3 of FIG. 1.
Figure 4:
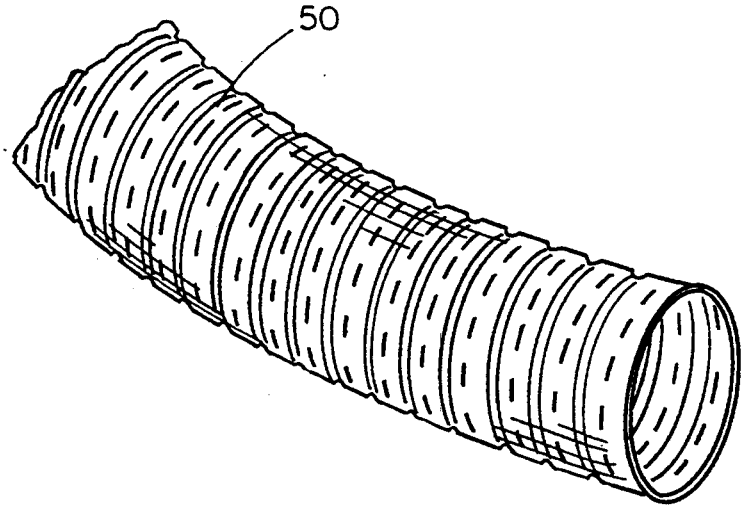
FIG. 4 is a partial perspective view of the perforated pipe which is placed in the bagged material.
Figure 5:
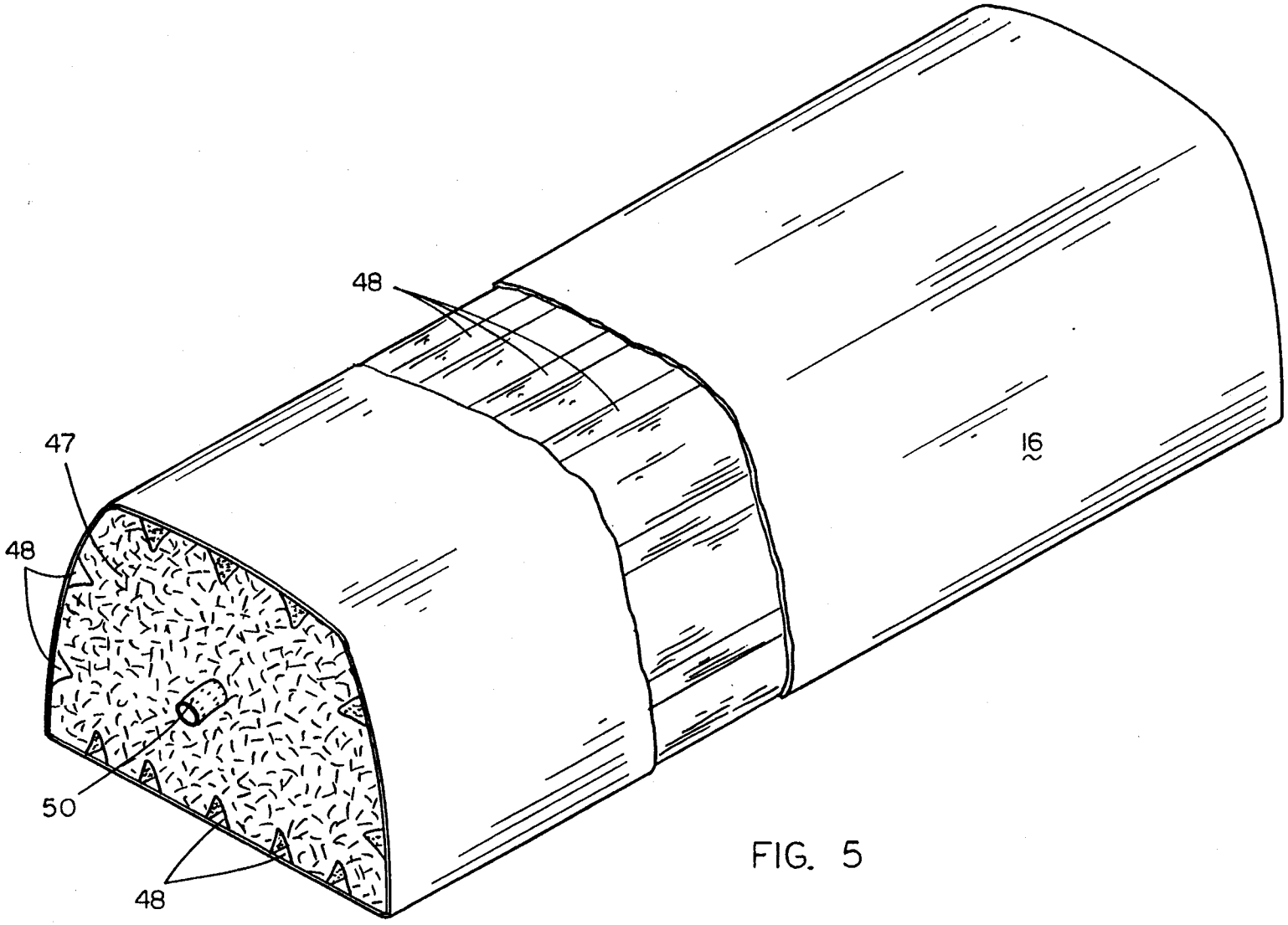
FIG. 5 is a perspective view of a bag having the compost material therein.

Reel 52 is rotatably mounted on the wheeled frame means above the tunnel 14 as seen in the drawings by any conventional fashion. The pipe 50 is coiled on the reel 52 and is fed therefrom downwardly and rearwardly through a pipe guide 54. It is recommended that the cross-section of the rearward end of the pipe guide 54 have the triangular cross-section as illustrated in FIG. 2. The distal end 56 of the pipe 50 would be extended outwardly of the distal end or the fixed end of the bag 16 as seen in FIG. 1. As the bagging machine moves relative to the bag 16, the pipe 50 is pulled from the reel 52 and is positioned in the approximate center of the mass as illustrated in FIGS. 1 and 5.

Although the reel 52 is preferred, it should be noted that individual sections of perforated pipe could be moved downwardly through the pipe guide means 54 as the bagging machine moves relative to the bag 16.

The V-shaped flutes 46 and the perforated pipe 50 ensure that sufficient air will be present in the material to achieve complete decomposition. Thus, it can be seen that the invention accomplishes at least all of its stated objectives.

I claim:

1. A compost bagging machine for bagging compost material into an elongated flexible bag having a fixed end and an open mouth, a wheeled frame means having rearward and forward ends, a tunnel means on said wheeled frame means and having an intake end for receiving compost material and an output end adapted to receive the mouth of the bag, a hopper means on said wheeled frame means for receiving compost material, means at the intake end of said tunnel means for forcing the compost material into said tunnel means, into said bag, and to move said wheeled frame means away from said fixed end of said bag, means associated with the bagging machine for creating air channels in the compost material in said bag to enhance the composting of the compost material, said means for creating air channels comprising positioning means which positions at least one elongated, perforated pipe extending substantially the entire length of the compost material in the bag as said bagging machine bags the compost material in said bag, said perforated pipe having openings formed therein for substantially the entire length thereof, and a pipe support on said wheeled frame means for supporting said perforated pipe thereon prior to said perforated pipe being positioned in said compost material by said positioning means as said bagging machine bags the compost material in said bag.

2. The machine of claim 1 wherein said tunnel means has inner and outer surfaces and wherein said means for creating air channels also comprises spaced-apart inwardly projecting flutes positioned on the inner surface of said tunnel means.

3. A compost bagging machine for bagging compost material into an elongated flexible bag having a fixed end and an open mouth, a wheeled frame means having rearward and forward ends, a tunnel means on said wheeled frame means and having an intake end for receiving compost material and an output end adapted to receive the mouth of the bag, a hopper means on said wheeled frame means for receiving compost material, means at the intake end of said tunnel means for forcing the compost material into said tunnel means, into said bag, and to move said wheeled frame means away from said fixed end of said bag, means associated with the bagging machine for creating air channels in the compost material in said bag to enhance the composting of the compost material, said means for creating air channels comprising means for positioning an elongated, perforated pipe means in the compost material, said means for positioning the elongated pipe means in the compost material includes means for positioning the pipe means in a substantially horizontal position, said means for positioning the elongated pipe means including a reel means positioned on said wheeled frame means outwardly of said tunnel means, said reel means having the elongated pipe means wound thereon, and a guide means for guiding the pipe means from said reel means into the interior of said tunnel means.

4. The compost bagging machine of claim 1 wherein said pipe support comprises a reel means.

* * * * *